US005146797A

United States Patent [19]

Annovazzi et al.

[11] Patent Number: 5,146,797

[45] Date of Patent: Sep. 15, 1992

[54] SUPPORT HOUSING FOR AN ELECTRIC STARTER MOTOR FOR AN INTERNAL COMBUSTION ENGINE

[75] Inventors: Lorella Annovazzi, Segrate; Fabio Arpino, Milan, both of Italy

[73] Assignee: Industrie Magneti Marelli SpA, Milan, Italy

[21] Appl. No.: 718,472

[22] Filed: Jun. 20, 1991

[30] Foreign Application Priority Data

Jun. 20, 1990 [IT] Italy ..... 53093/90[U]

[51] Int. Cl.[5] ..... F02N 15/06

[52] U.S. Cl. ..... 74/6; 74/7 R; 74/7 A; 74/606 R; 310/89

[58] Field of Search ..... 74/6, 7 R, 7 A, 606 R; 248/674; 290/48; 310/89, 91

[56] References Cited

U.S. PATENT DOCUMENTS

| | | | |
|---|---|---|---|
| 4,155,266 | 5/1979 | Bradley | 74/606 R X |
| 4,362,065 | 12/1982 | Baratti | 74/7 A |
| 4,553,442 | 11/1985 | Mazzorana | 74/7 A |
| 4,663,979 | 5/1987 | VanSickle | 74/7 A |
| 5,016,484 | 5/1991 | Morikane | 74/7 A X |

*Primary Examiner*—Allan D. Herrmann

*Attorney, Agent, or Firm*—Sughrue, Mion, Zinn, Macpeak & Seas

[57] ABSTRACT

The housing has a bell-shaped end portion with an axial aperture in which the output pinion of the starter motor unit is supported for rotation and a side aperture through which the pinion can mate with a rotary member of the internal combustion engine. The side wall of the bell-shaped portion opposite the side aperture has a recess with a flat wall portion extending in a plane substantially parallel to the axis of the bell-shaped portion.

2 Claims, 1 Drawing Sheet

SUPPORT HOUSING FOR AN ELECTRIC STARTER MOTOR FOR AN INTERNAL COMBUSTION ENGINE

BACKGROUND OF THE INVENTION

The present invention relates to a support housing for an electric starter motor unit for an internal combustion engine, particularly for motor vehicles.

More specifically, the subject of the invention is a support housing including a substantially bell-shaped end body with a central axial hole in which the output pinion of the starter motor unit is supported for rotation in use, and a side aperture through which the pinion can mate with a rotary member of the internal combustion engine.

Typically, in support housings of this type produced up to now, the bell-shaped end portion is in the form of a body of revolution.

SUMMARY OF THE INVENTION

The object of the present invention is to provide a support housing of the aforesaid type whose shape is modified so as to reduce the stresses thereon and its deformation under load, as well to reduce the bulk and weight of the housing.

According to the invention, this and other objects are achieved by a support housing of the type specified above, whose main characteristic lies in the fact that the side wall of the bell-shaped portion opposite the side aperture has a recess with a flat wall portion extending a plane substantially parallel to the axis of the body.

As well as achieving the object mentioned above, this characteristic also enables a reduction in the thickness of a bell-shaped portion of a given structural strength.

BRIEF DESCRIPTION OF THE DRAWINGS

Further characteristics and advantages of the invention will become clear from the detailed description which follows with reference to the appended drawings provided purely by way of non-limiting example, in which.

DETAILED DESCRIPTION OF THE INVENTION

Figure 1:
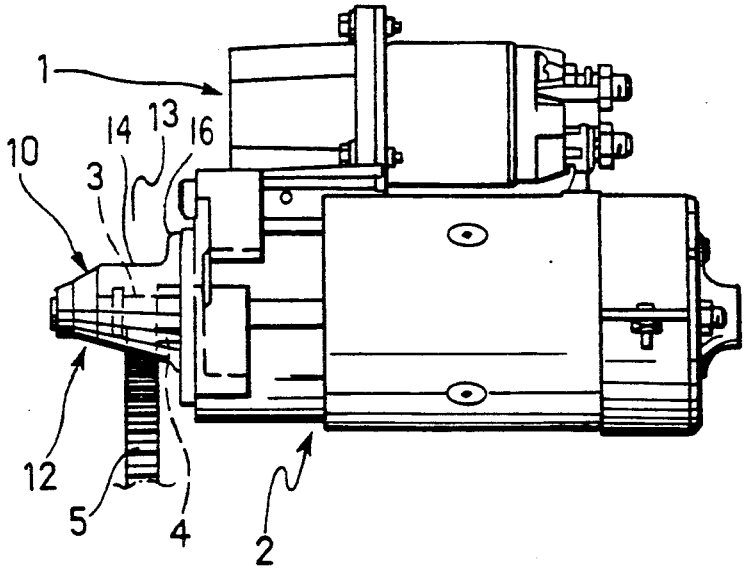
FIG. 1 is a side view of an electric starter motor unit according to the invention.

In FIG. 1, an electric starter motor unit for an internal combustion engine is generally indicated 1. The unit has a housing, generally indicated 2, in which a direct-current electric motor, an associated geared reduction unit, and an overrunning (free-wheel) clutch which connects the output of the reduction unit to an output shaft 3 (shown in broken outline) carrying a drive pinion 4 are mounted, in known manner. The pinion can be coupled, in known manner, to a rotary member 5 of the internal combustion engine (not shown). Typically, the member 5 is a ring gear.

Figure 2:
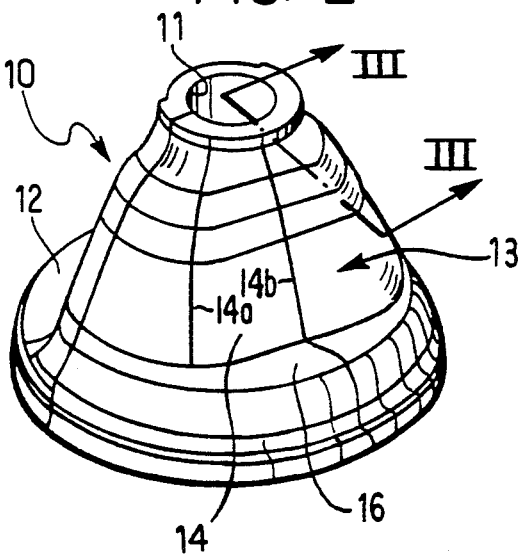
FIG. 2 is a perspective view of the bell-shaped end portion of the housing according to the invention.
Figure 3:
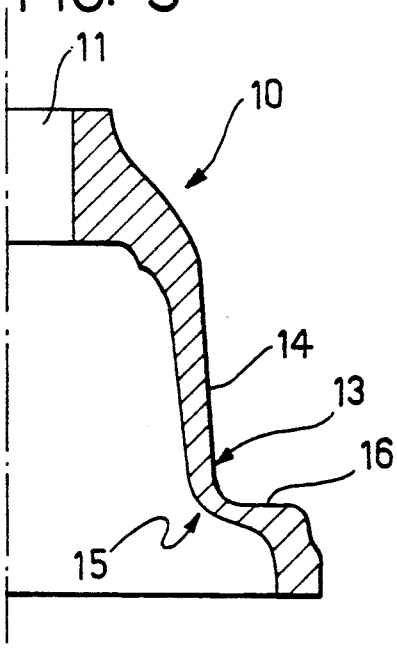
FIG. 3 is a partial sectional view taken on the line III—III of FIG. 2.

The housing 2 has a substantially bell-shaped end portion or body 10 which may be seen better in FIGS. 2 and 3.

The end portion may be formed in one piece with the rest of the housing or may be a separate and distinct body fitted to the rest of the housing or casing, for example, by means of screws.

As can better be seen in FIGS. 2 and 3, the bell-shaped body 10 has a central axial hole 11 in which the output shaft 3 carrying the pinion 4 is supported for rotation in use.

The bell-shaped body 10 also has a side aperture 12 (FIGS. 1 and 2) through which the pinion 4 can mate with the rotary member 5 of the internal combustion engine.

The side wall of the bell-shaped body 10 opposite the side aperture 12 has a recess, indicated 13 in FIG. 3, with a flat wall portion 14 extending in a plane substantially parallel to the axis of the body between opposite edges 14*a* and 14*b*. In the embodiment illustrated, the wall portion 14 is joined at 15 (FIG. 3) to a wall portion 16 which extends in a plane almost perpendicular to the axis of the body 10.

Figure 4:
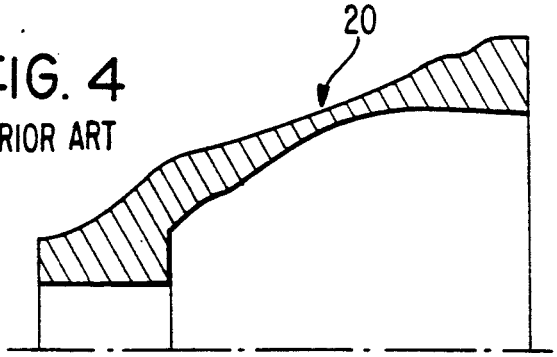
FIG. 4 PRIOR ART
FIG. 4 is a view similar to FIG. 3 showing a prior art shape.

As can be seen in FIG. 2, the side wall of the body 10 beside the recess 13 is shaped like a body of revolution. FIG. 4 shows the shape of the cross-section of the bell-shaped portion 20 of a prior-art support housing. The substantial difference in shape between the bell-shaped body 10 according to the invention and that of the prior-art body 20 can thus be appreciated from this drawing.

The particular shape of the bell-shaped body 10 according to the invention, as described above, achieves an appreciable reduction (of about 10–15%) in stress and deformation. Moreover, the particular shape of the bell-shaped body enables it to be thinner, less bulky and lighter for a given structural strength.

The shape described above can be achieved in practically all the starter units currently in production.

I claim:

1. A support housing for an electric starter motor unit (1) for an internal combustion engine, particularly for motor vehicles including a substantially bell-shaped end body (10) with a central axial hole (11) in which a shaft for carrying an output pinion (4) of a starter motor unit (1) is supported for rotation in use, and a side aperture (12) through which the pinion (4) can mate with a rotary member (5) of the internal combustion engine, wherein the side wall of the bell-shaped body (10) opposite the side aperture (12) has a recess (13) with a flat wall portion (14) extending in a plane substantially parallel to the axis of the body (10).

2. A support housing according to claim 1, wherein the recess (13) in the bell-shaped body (10) has a flat wall portion (16) extending in a plane substantially perpendicular to the axis of the body (10).

* * * * *